US010098460B1

(12) United States Patent
Brinton, Jr.

(10) Patent No.: US 10,098,460 B1
(45) Date of Patent: Oct. 16, 2018

(54) SHELF BRACKETS, HANG ROD BRACKETS, AND STORAGE SYSTEMS INCLUDING THE SAME

(71) Applicant: Clairson, Inc., Newark, DE (US)

(72) Inventor: Daniel Wayne Brinton, Jr., Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 15/684,188

(22) Filed: Aug. 23, 2017

(51) Int. Cl.

| | |
|---|---|
| ***A47B 96/14*** | (2006.01) |
| ***A47B 96/06*** | (2006.01) |
| ***A47F 5/08*** | (2006.01) |
| ***A47B 61/00*** | (2006.01) |
| *A47B 45/00* | (2006.01) |

(52) U.S. Cl.
CPC ..... *A47B 96/145* (2013.01); *A47B 61/003* (2013.01); *A47B 96/06* (2013.01); *A47F 5/08* (2013.01); *A47B 45/00* (2013.01)

(58) Field of Classification Search
CPC ..... A47B 96/145; A47B 61/003; A47B 96/06; A47B 45/00; A47F 5/08
USPC ..... 248/222.11
See application file for complete search history.

(56) References Cited

U.S. PATENT DOCUMENTS 2,837,219 A * 6/1958 Ferdinand ..... A47B 57/485 108/185
3,702,591 A * 11/1972 Banse ..... A47B 96/027 108/31
3,858,988 A * 1/1975 Cohen ..... F16L 37/22 211/189
4,129,279 A * 12/1978 Burkholder ..... A01K 31/17 211/182
5,697,233 A * 12/1997 Albert ..... E05B 73/0082 248/551
5,899,035 A * 5/1999 Waalkes ..... E04B 2/7433 52/239
6,402,108 B1 6/2002 Remmers
6,612,078 B2 * 9/2003 Hawang ..... A47B 47/042 403/353
6,637,707 B1 * 10/2003 Gates ..... A47B 81/005 211/64
6,883,769 B2 * 4/2005 Shamoon ..... B42F 9/001 24/67 R
6,926,244 B1 * 8/2005 O'Neill ..... E05B 73/0082 248/346.01

(Continued)

*Primary Examiner* — Ko H Chan
(74) *Attorney, Agent, or Firm* — Harness, Dickey & Pierce, P.L.C.; Anthony G. Fussner

(57) ABSTRACT

In an exemplary embodiment, a hang rod bracket may include a tab along an upper portion of the hang rod bracket. A shelf bracket may include a resiliently flexible tang along a lower portion of the shelf bracket. The resiliently flexible tang may be resiliently movable in a first direction when impinged by the tab of the hang rod bracket, such as during installation of the hang rod bracket onto the shelf bracket. The resiliently flexible tang may be resiliently movable in a second, opposite direction when the tab is not impinging the resiliently flexible tang, such as after the hang rod bracket has been fully installed onto the shelf bracket and the tab has been rearwardly moved beyond the resiliently flexible tang. The resiliently flexible tang may engage the tab to inhibit forward movement of the hang rod bracket along the shelf bracket.

21 Claims, 15 Drawing Sheets

(56) References Cited

U.S. PATENT DOCUMENTS

| | | | | |
|---|---|---|---|---|
| 7,086,544 | B1 * | 8/2006 | Doench | A47B 61/003 211/105.1 |
| D580,258 | S | 11/2008 | Fernandez | |
| 7,900,783 | B2 * | 3/2011 | Fernandez | A47B 45/00 108/108 |
| D668,136 | S | 10/2012 | Nicholls et al. | |
| 2005/0150850 | A1 * | 7/2005 | Stitchick | A47B 47/022 211/90.03 |

* cited by examiner

SHELF BRACKETS, HANG ROD BRACKETS, AND STORAGE SYSTEMS INCLUDING THE SAME

FIELD

The present disclosure generally relates to storage systems, such as a closet storage system including shelf brackets for supporting shelves and hang rod brackets for supporting hang rods or poles beneath the shelves.

BACKGROUND

This section provides background information related to the present disclosure which is not necessarily prior art.

Efficient and organized use of building space is very desirable, particularly with respect to storage or utility space in businesses, residential homes, and apartments. In particular, because of the limited or tight spaces in these locations, increasing the amount of useable space is very important. Likewise, providing ease in access and increased user convenience is important.

With respect to closet organization and the design of closet storage units, particularly for residential use, many different options are available including, for example, different sizes and shapes of shelves, different attachment and mounting members and different storage members (e.g., wire baskets, shoe-stands, tie/belt racks, hang rods, etc.). Ease in accessing stored items, such as clothing, is important. Further, ease in moving stored items to make room for other items or to access items not readily accessible, is likewise important. For example, poles or hang rods may be supported beneath a shelf to provide for relatively easy movement of items along the hang rod, for example, sliding clothes on hangers along the pole or hang rod.

Standards may be used for supporting shelf brackets, such as within a closet, etc. A typical standard may include a relatively narrow strip of material with two columns of slots on the front surface thereof. The standard may be mounted vertically against a back wall of a closet. Shelf brackets may be supported from the standard by inserting tabs of the shelf brackets into corresponding slots of the standard.

DRAWINGS

The drawings described herein are for illustrative purposes only of selected embodiments and not all possible implementations, and are not intended to limit the scope of the present disclosure.

Figure 2:
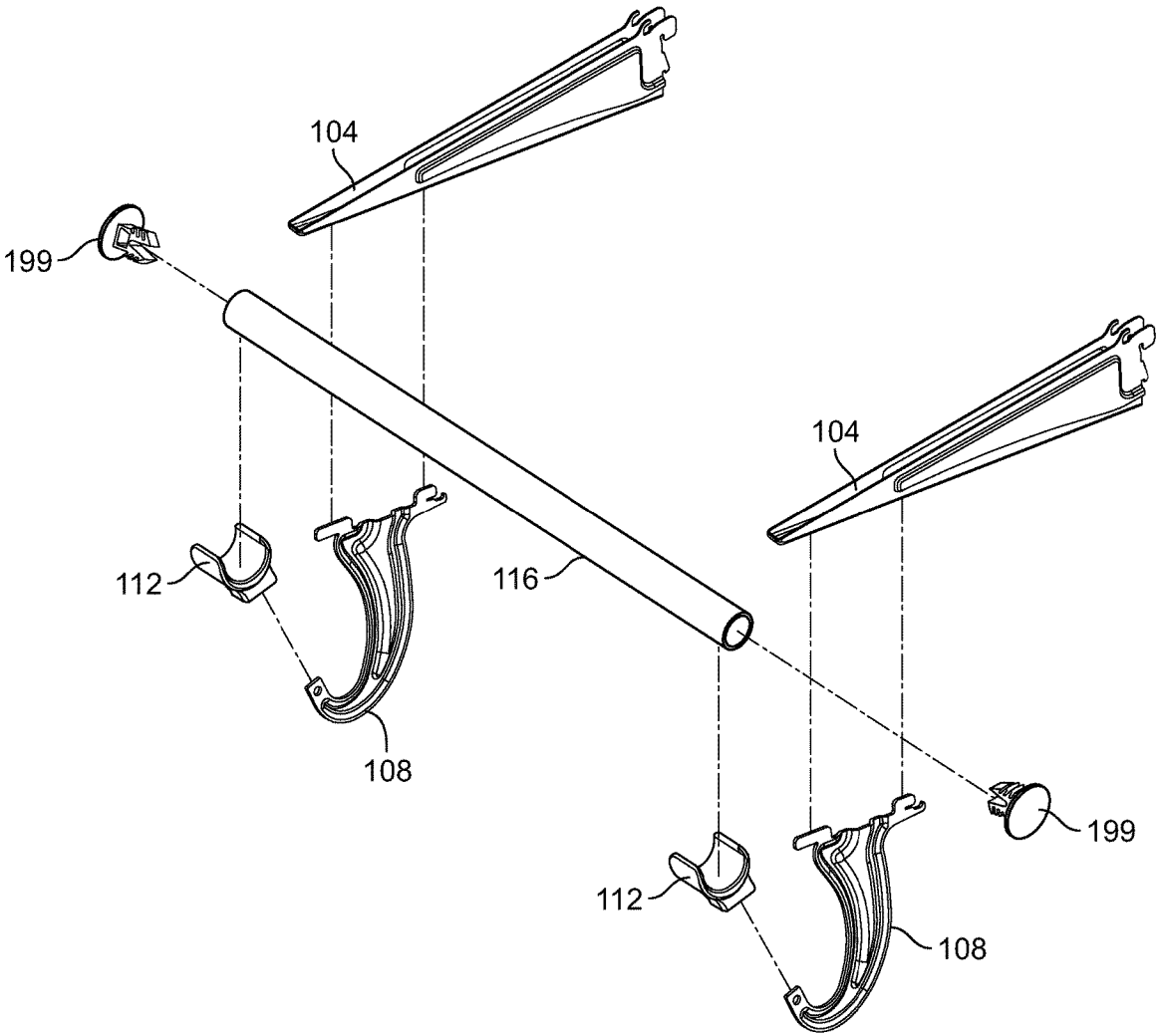
FIGS. 2 and 3 are exploded upper and lower perspective views of the upper shelf brackets, hang rod brackets, pole cups, and hang rod or pole shown in FIG. 1.
Figure 3:
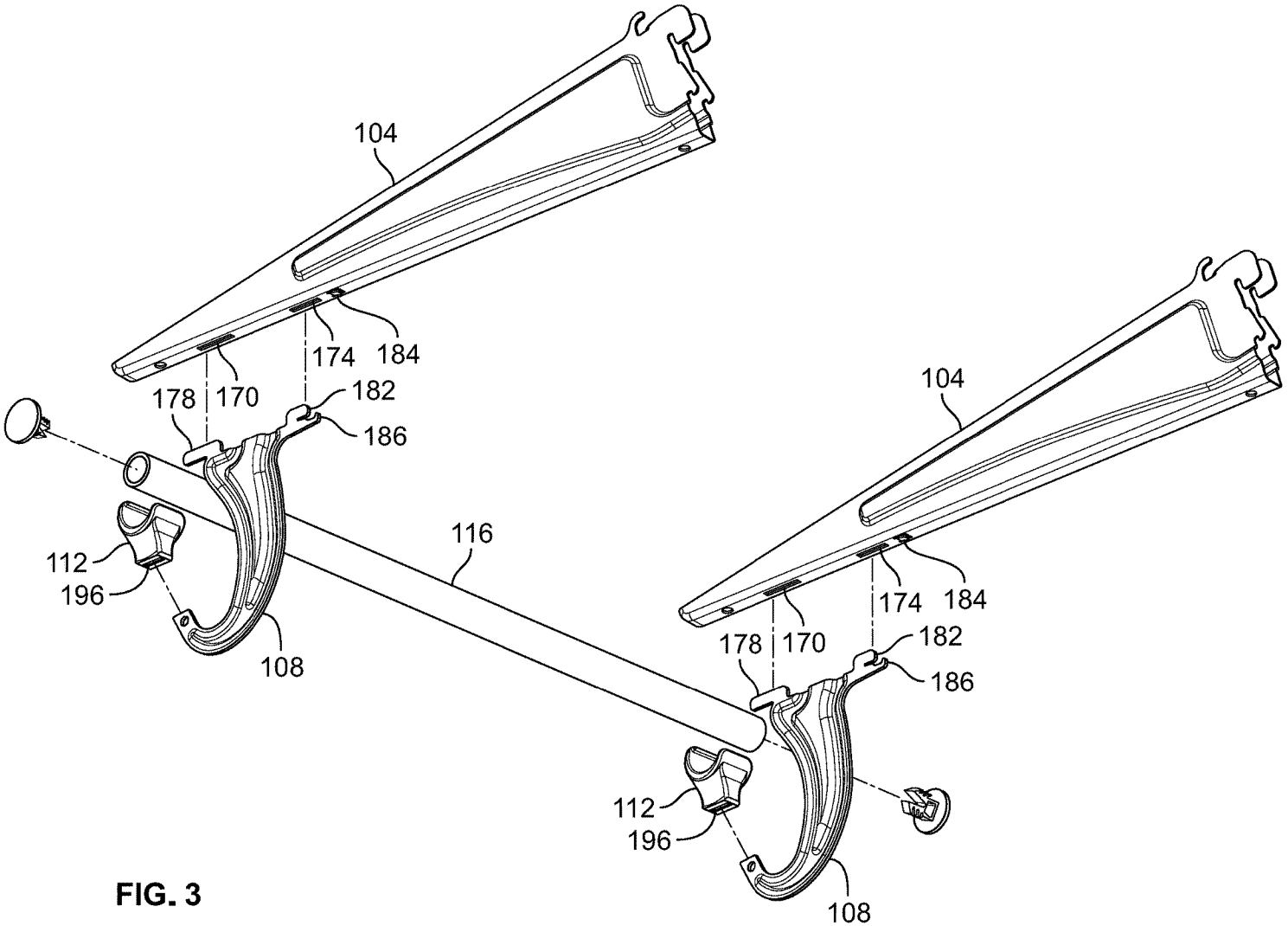
Figure 4:
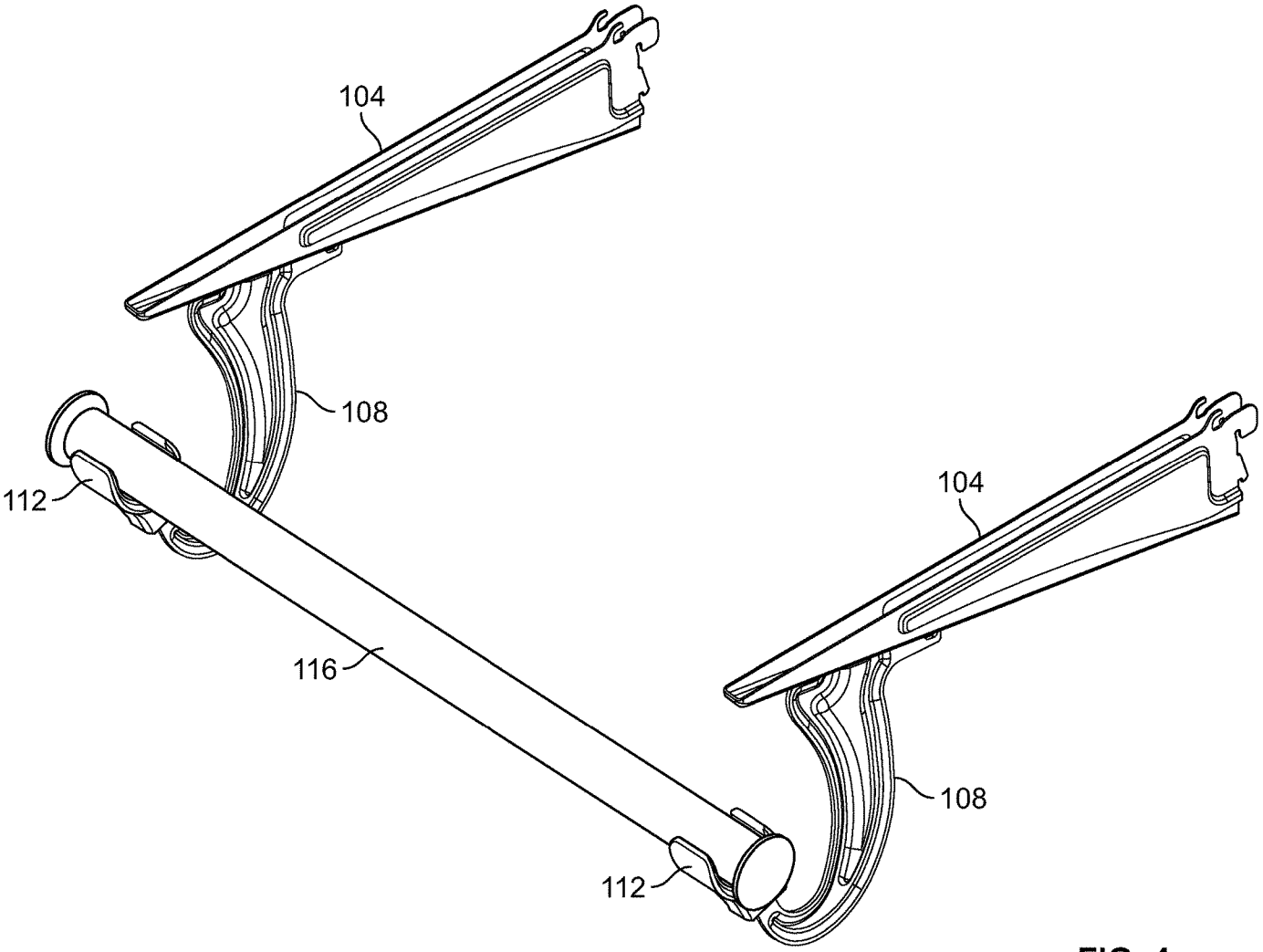
Figure 5:
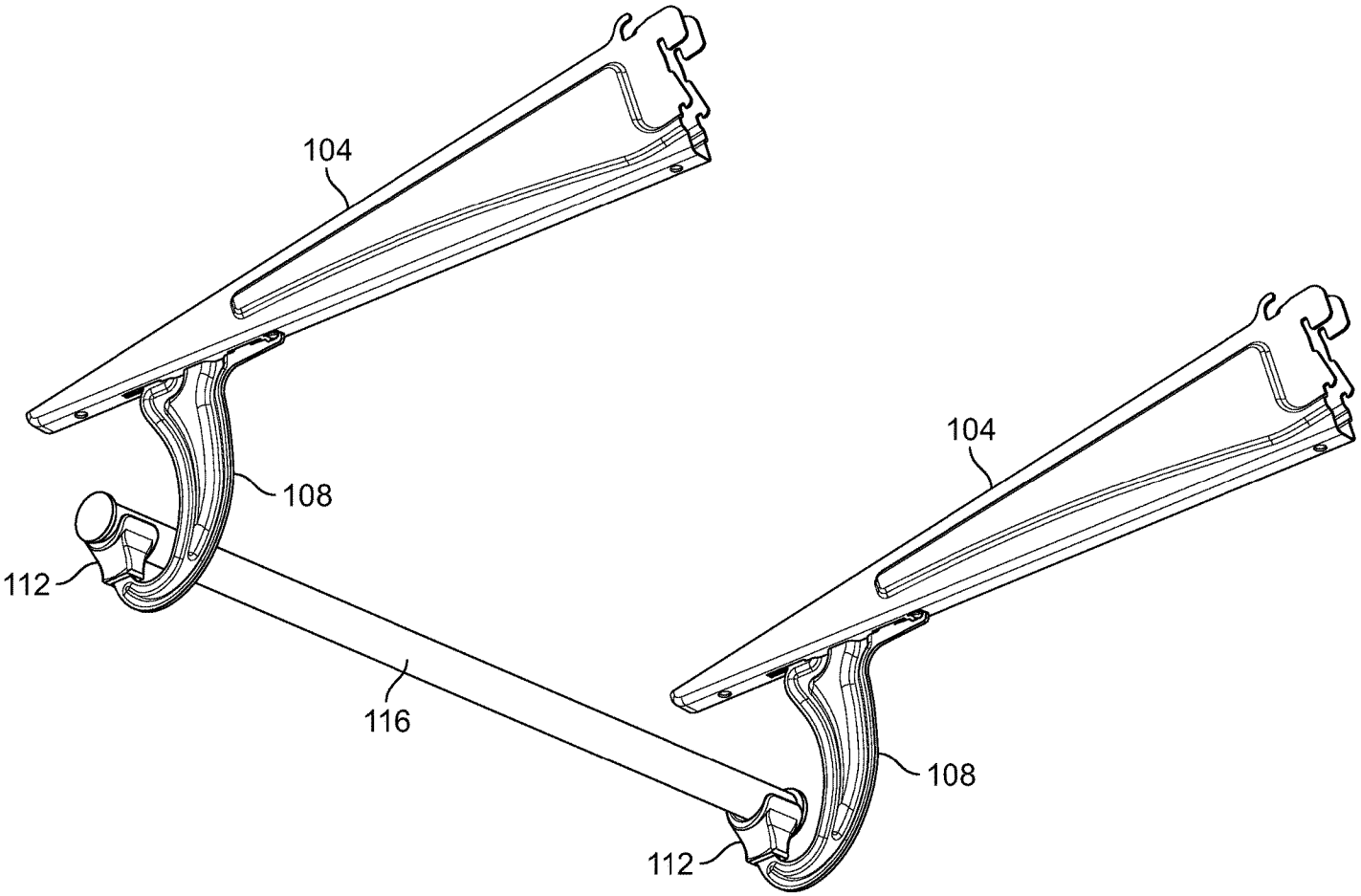

FIGS. 4 and 5 are upper and lower perspective views of the shelf brackets, hang rod brackets, pole cups, and hang rod or pole shown in FIGS. 2 and 3 after being assembled together. The hang rod brackets are supported or suspended from the shelf brackets. The hang rod or pole is supported within the pole cups that are coupled to the hang rod brackets.

Figure 6:
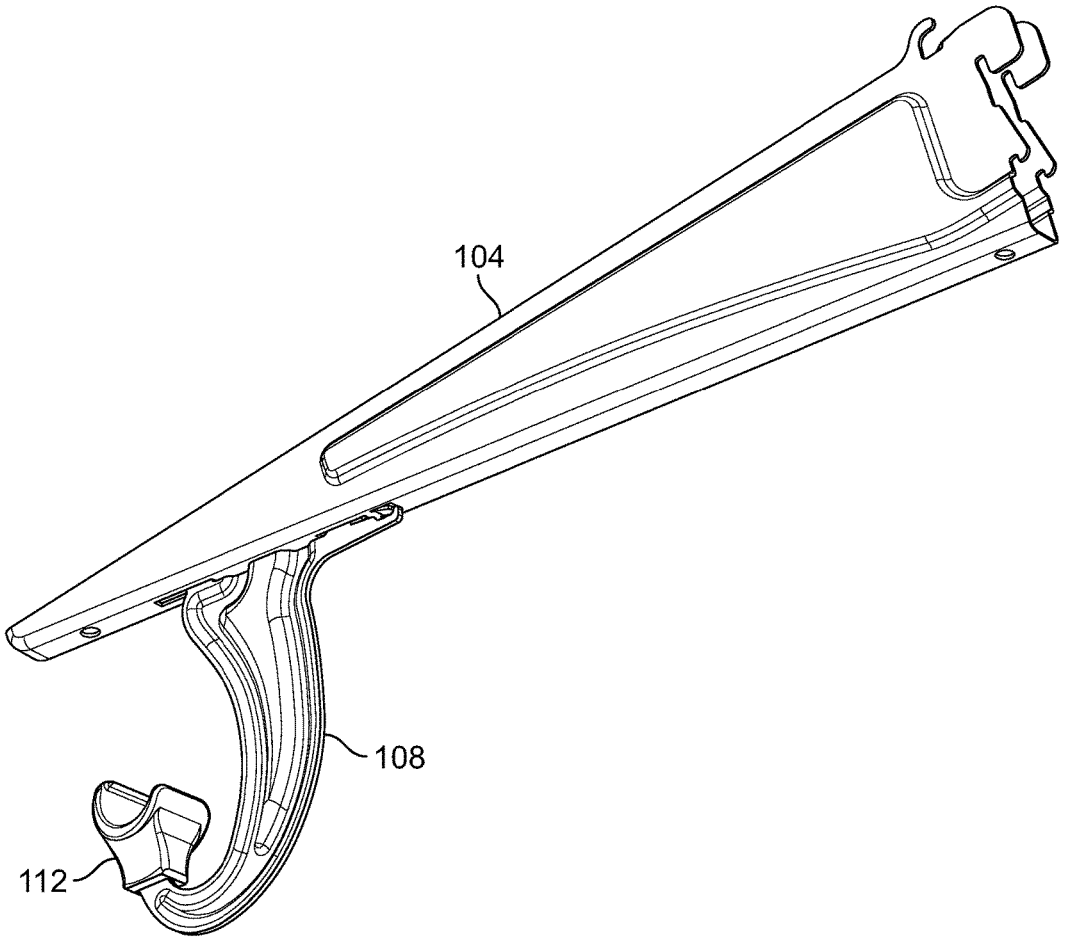

FIG. 6 is a perspective view showing a shelf bracket, hang rod bracket, and pole cup shown in FIGS. 4 and 5.

Figure 7:
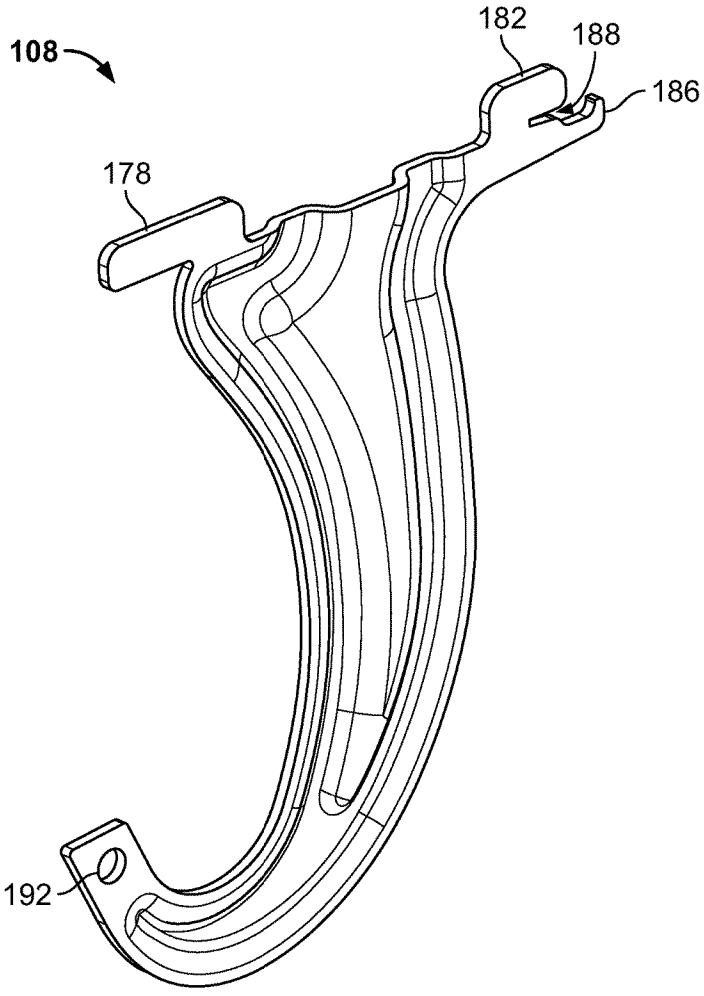

FIG. 7 is an upper perspective view of one of the two hang rod brackets shown in FIGS. 2 through 5.

Figure 8:
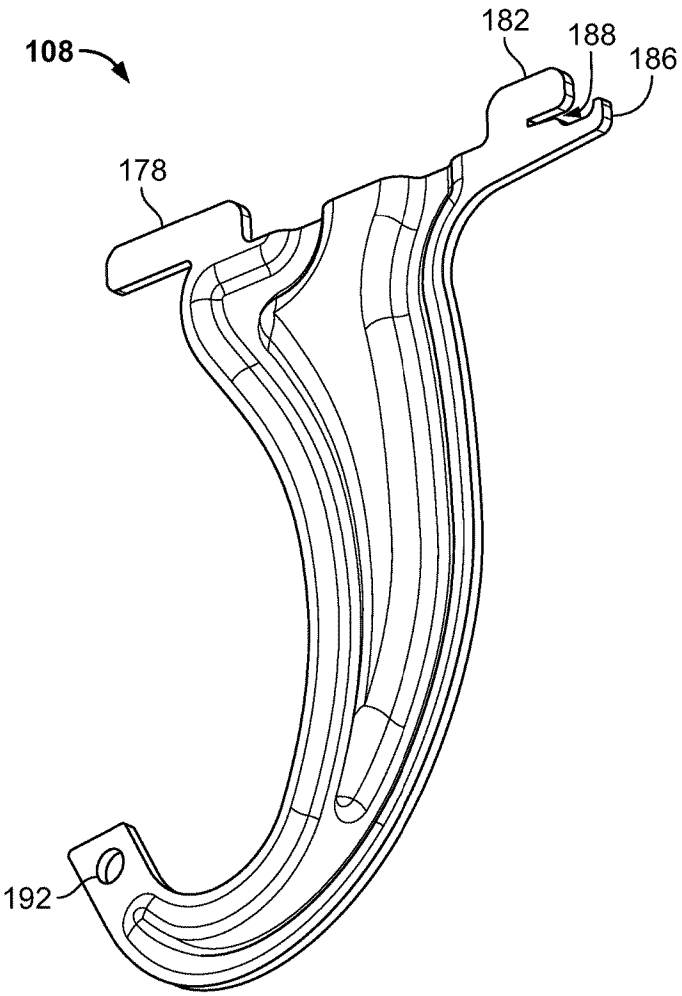

FIG. 8 is a lower perspective view of the hang rod bracket shown in FIG. 7.

Figure 9:
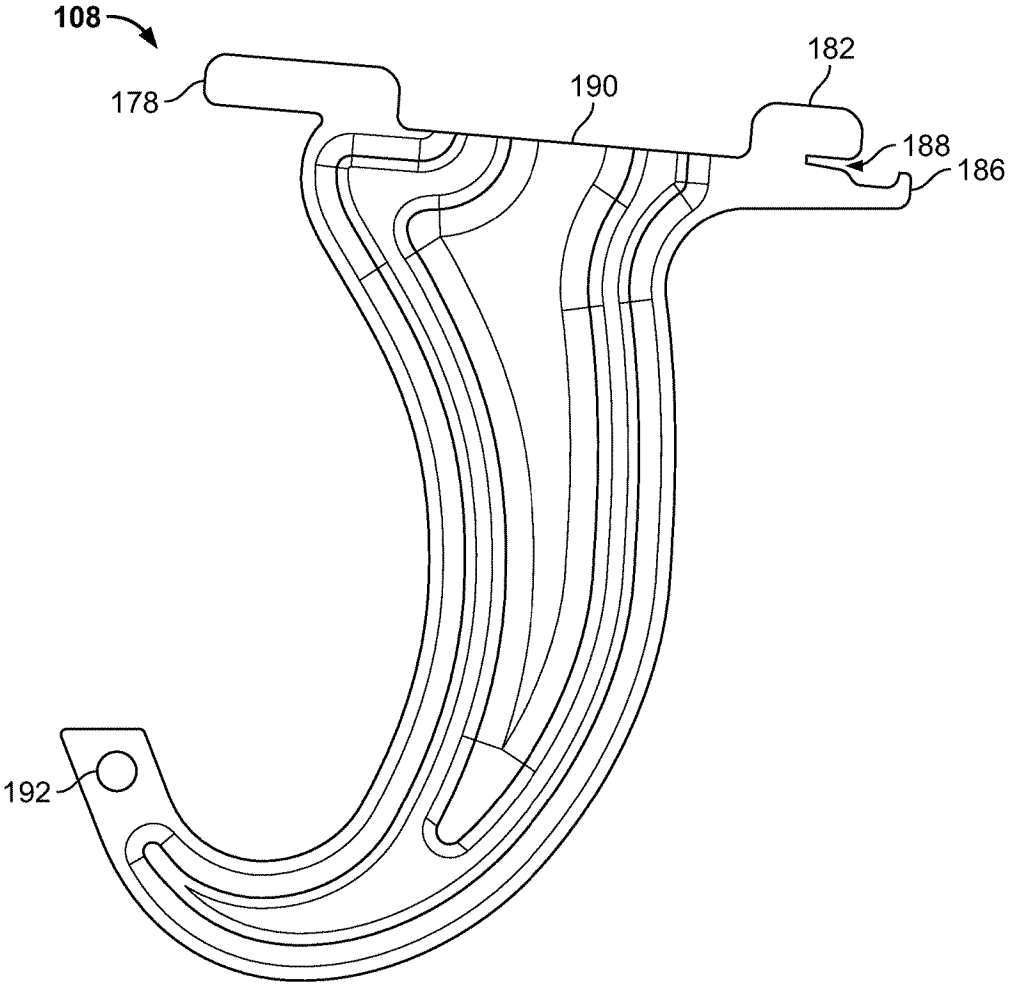

FIG. 9 is a side view of the hang rod bracket shown in FIG. 7.

Figure 10:
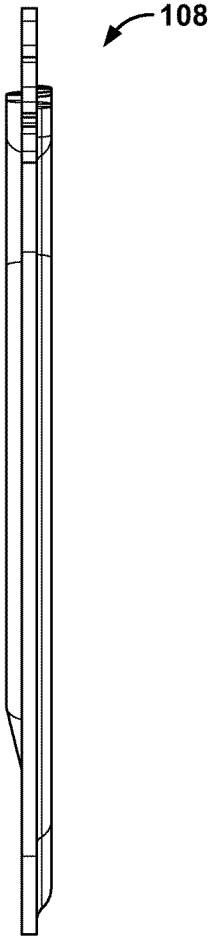

FIG. 10 is a front view of the hang rod bracket shown in FIG. 7.

Figure 11:
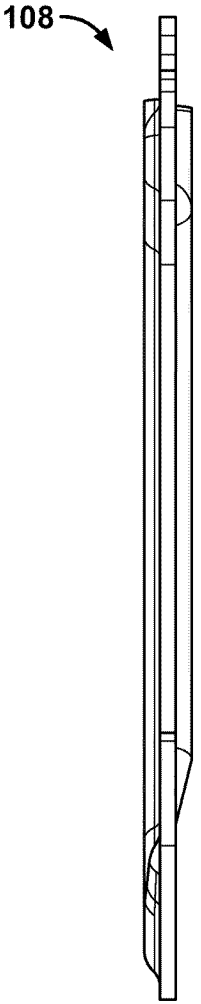

FIG. 11 is a back view of the hang rod bracket shown in FIG. 7.

Figure 12:
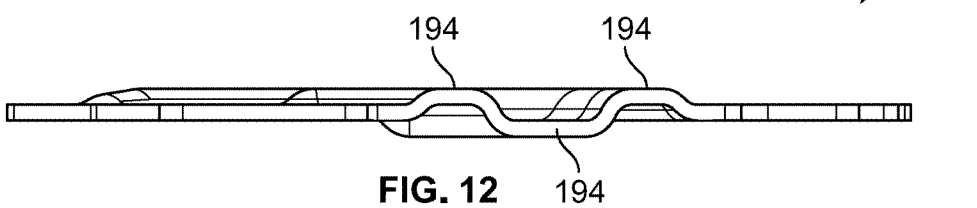

FIG. 12 is a top view of the hang rod bracket shown in FIG. 7.

Figure 13:
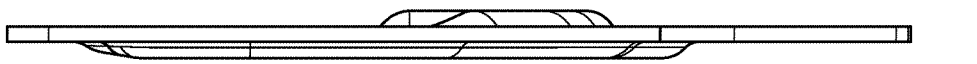

FIG. 13 is a bottom view of the hang rod bracket shown in FIG. 7.

Figure 14:
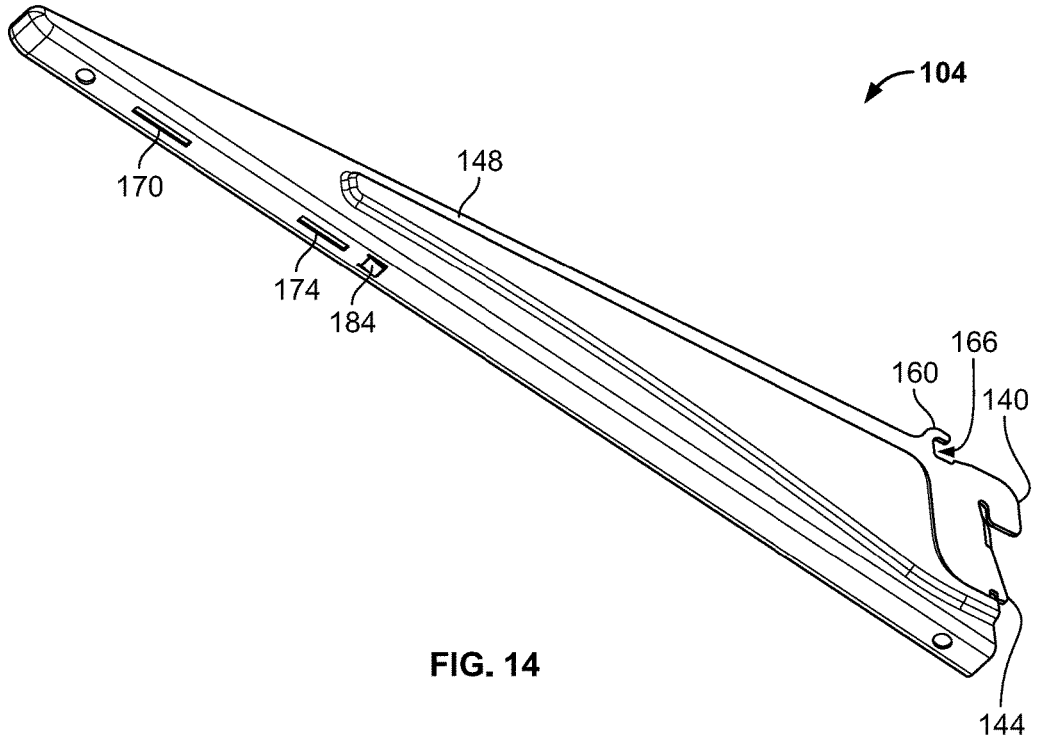

FIG. 14 is a front lower perspective view of one of the two shelf bracket shown in FIGS. 2 through 5. The shelf bracket may be supported by a standard mounted against a wall by inserting tabs of the shelf bracket within slots of the standard. The shelf bracket may then be used to help support a shelf (e.g., ventilated or wire shelf, laminate shelf, wooden shelf, etc.).

Figure 15:
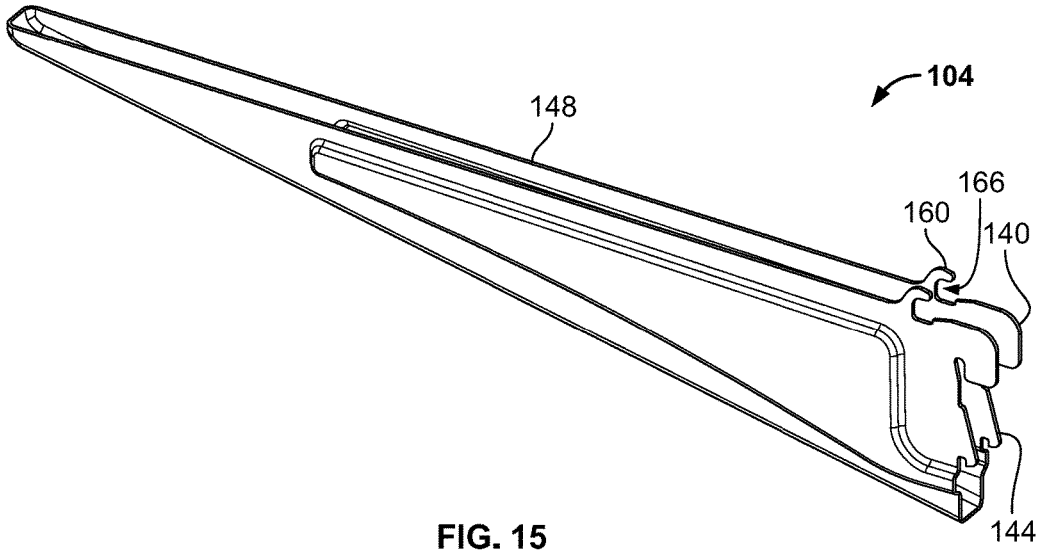

FIG. 15 is a back upper perspective view of the shelf bracket shown in FIG. 14.

Figure 16:
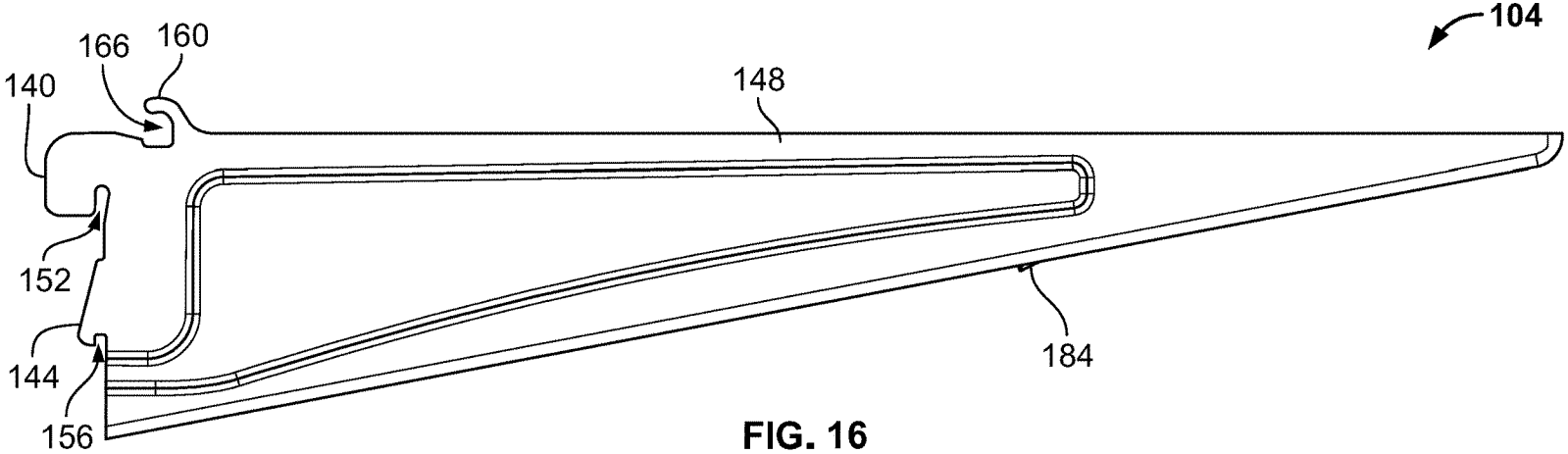

FIG. 16 is a side view of the shelf bracket shown in FIG. 14.

Figure 17:
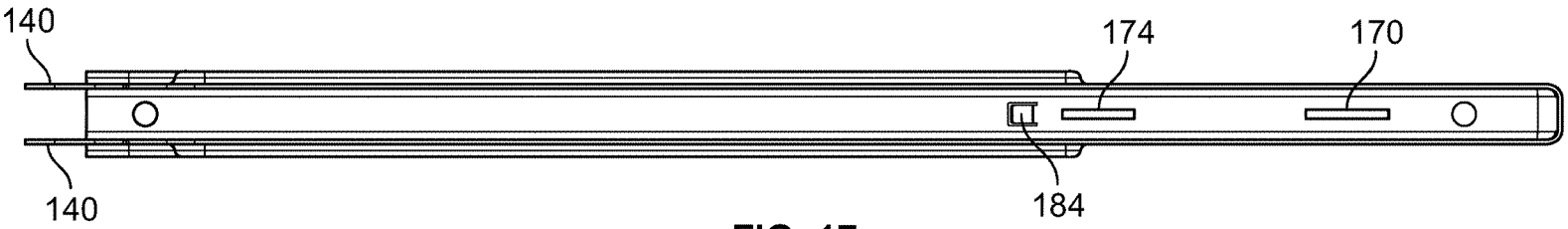

FIG. 17 is a top view of the shelf bracket shown in FIG. 14.

Figure 18:
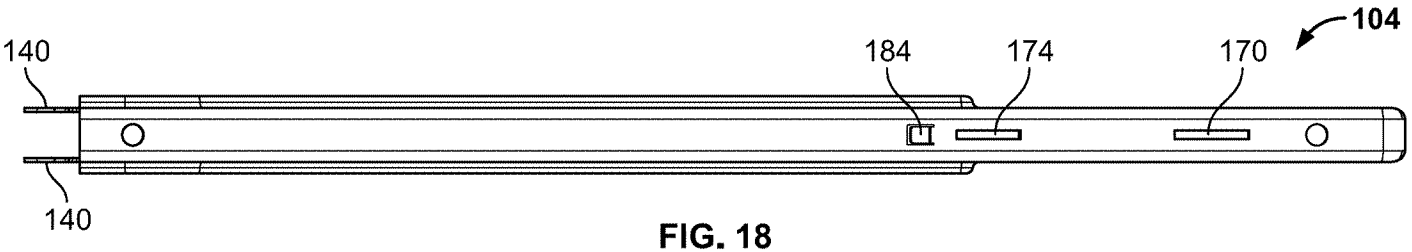

FIG. 18 is a bottom view of the shelf bracket shown in FIG. 14.

Figure 19:
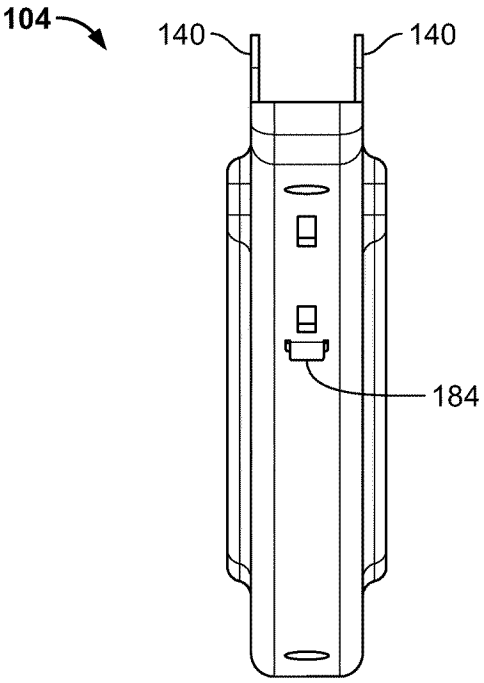

FIG. 19 is a front view of the shelf bracket shown in FIG. 14.

Figure 20:
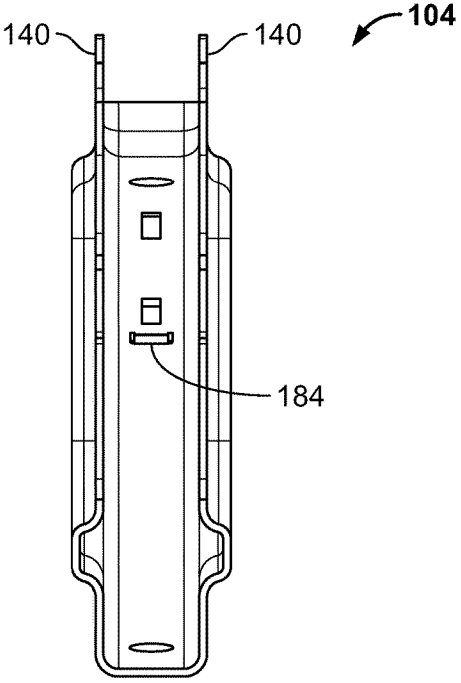

FIG. 20 is a back view of the shelf bracket shown in FIG. 14.

Figure 21:
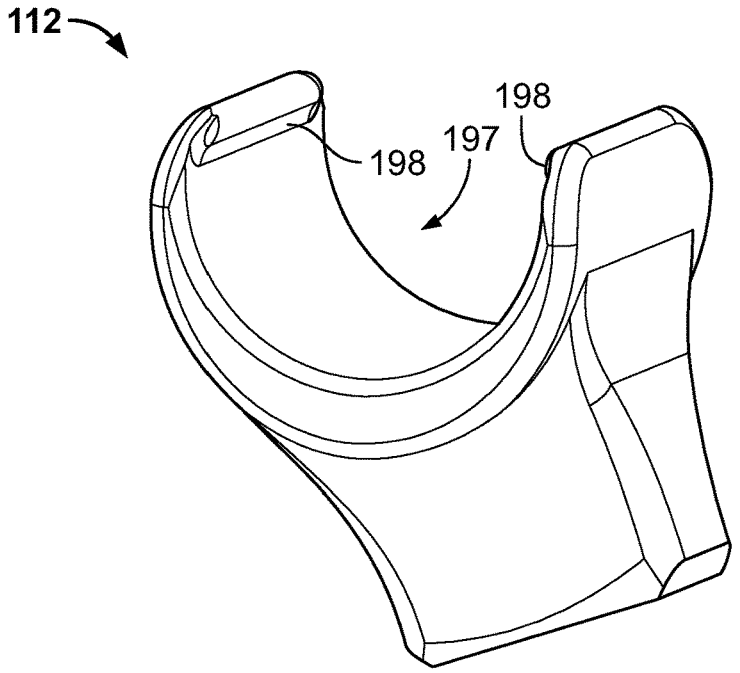

FIG. 21 is an upper perspective view of one of the two pole cups shown in FIGS. 2 through 5. The pole cup may be attached to a hang rod bracket. The pole cup may be used for helping to support a hang rod or pole.

Figure 22:
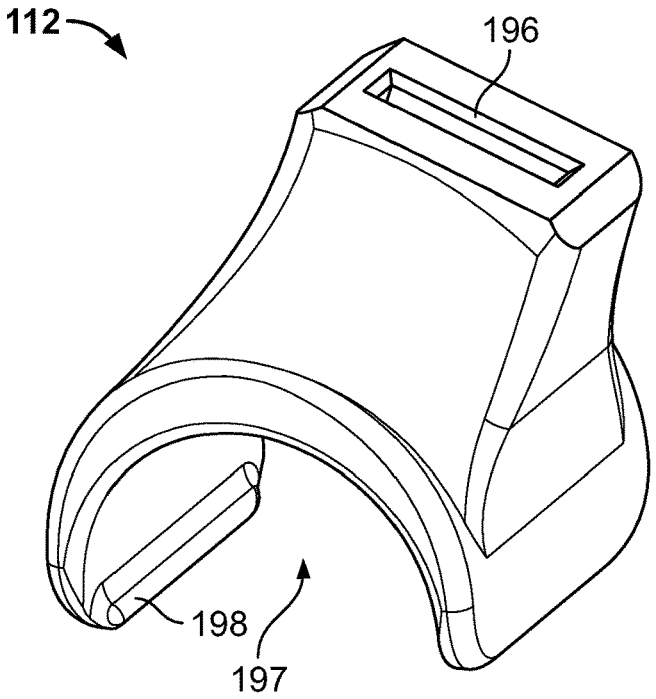

FIG. 22 is a lower perspective view of the pole cup shown in FIGS. 1 through 5.

Figure 23:
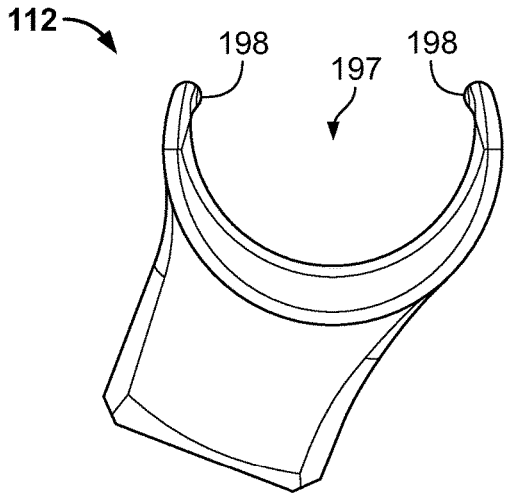

FIG. 23 is a side view of the pole cup shown in FIGS. 1 through 5.

Figure 24:
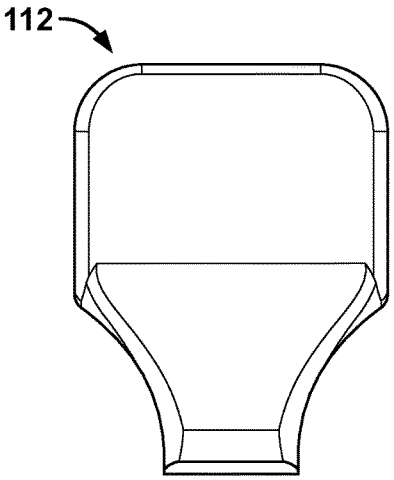

FIG. 24 is a front view of the pole cup shown in FIGS. 1 through 5.

Figure 25:
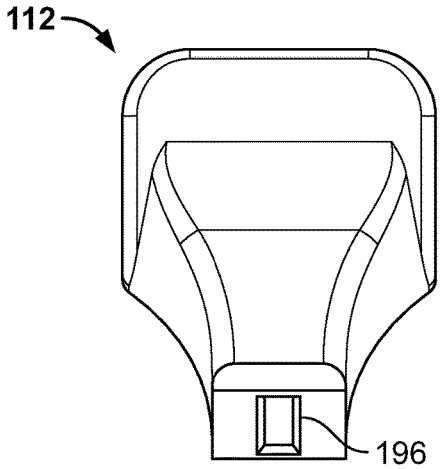

FIG. 25 is a back view of the pole cup shown in FIGS. 1 through 5.

Figure 26:
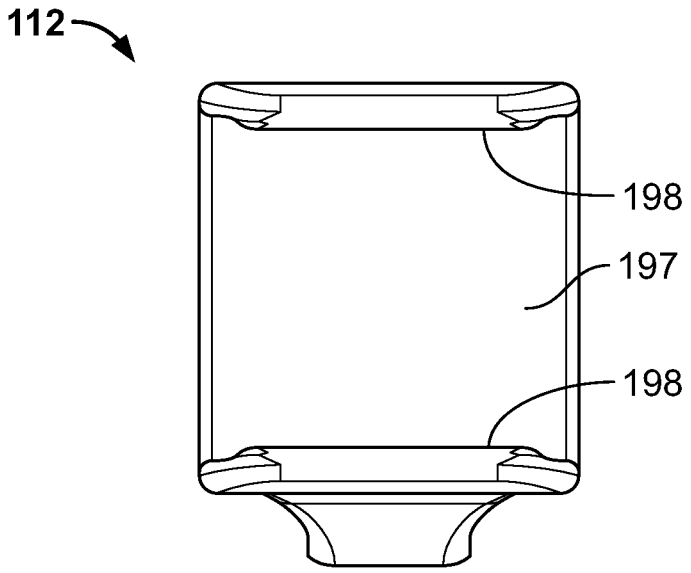
Figure 27:
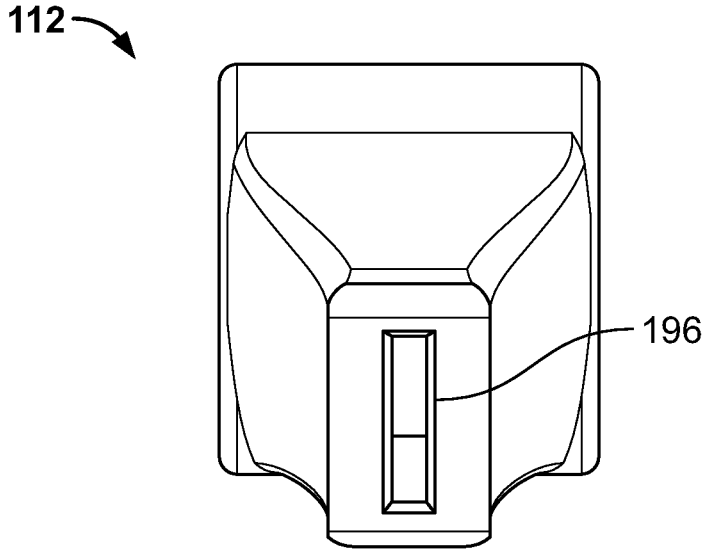

FIG. 26 is a top view of the pole cup shown in FIGS. 1 through 5. and FIG. 27 is a bottom view of the pole cup shown in FIGS. 1 through 5.

Corresponding reference numerals indicate corresponding parts throughout the several views of the drawings.

DETAILED DESCRIPTION

Example embodiments will now be described more fully with reference to the accompanying drawings.

According to various aspects of the present disclosure, exemplary embodiments are disclosed of shelf brackets for supporting shelves and/or hang rod brackets for supporting hang rods or poles beneath the shelf brackets and shelves supported thereby. The hang rod brackets are configured to be suspended or supported from the shelf brackets. Also disclosed are exemplary embodiments of storage systems including the shelf brackets and/or hang rod brackets In exemplary embodiments disclosed herein, the hang rod bracket may comprise a generally flat J-shaped or hook-shaped bracket (e.g., stamped sheet metal, plastic, etc.). A first or upper end portion of the hang rod bracket may include one or more tabs configured to be inserted within slots or openings along a lower portion of a shelf bracket to thereby suspend or support the hang rod bracket from the shelf bracket. A pole cup may be integrally formed with, fixedly attached to (e.g., welded, adhesively bonded, etc.), or removably attached to (e.g., via a friction, interference, or snap fit, etc.) a second or lower end portion of the hang rod bracket.

The hang rod bracket and shelf bracket may be cooperatively configured to provide an attachment mechanism (e.g., tab, slot, lock, etc.) for attaching the hang rod bracket to the shelf bracket in a manner that provides enhanced safety and functionality. As disclosed herein, the shelf bracket may include a resiliently flexible portion, tab, flap, or tang that will flex out of the way when impinged by a tab along the first or upper end portion of the hang rod bracket. After the tabs of the hang rod bracket have been fully inserted into the openings along the lower surface of the shelf bracket, the resiliently flexible portion, tab, flap, or tang of the shelf bracket will resiliently flex, snap, or move back into its original place thereby preventing accidental disengagement of the hang rod bracket from the shelf bracket.

The hang rod bracket may also include embossing or portions (e.g., embossed or stamped portions, etc.) protruding outwardly in opposite directions relative to a neutral center plane of the hang rod bracket. The embossing may provide enhanced lateral stability for the single tab/slot configuration of the hang rod bracket in exemplary embodiments.

The pole cups may be configured to engagingly receive portions (e.g., circumferential portions, etc.) of a hang rod or pole therein to thereby help support the hang rod or pole beneath the shelf brackets and shelf supported atop the shelf brackets. By way of example, the pole cups may be configured (e.g., made of resilient flexible material, etc.) to allow differently sized hang rods (e.g., hang rods having different diameters, etc.) to be used with the pole cups. The pole cups may be configured such that a friction, interference or snap fit is created between the pole cups and the hang rod or pole, which helps inhibit accidental removal of the hang rod or pole out of the pole cups.

The second or lower end portion of the hang rod bracket may include a hole or opening, which may be used for hanging the hang rod bracket when being coated. For example, the hole of the metal version of the hang rod bracket may be used for hanging the metal hang rod bracket when the metal is being coated with epoxy. The hole is located along the second end portion of the hang rod bracket such that the hole will be fully concealed when the pole cup (e.g., metal or plastic pole cup, etc.) is removably attached to the second end portion of the hang rod bracket. For example, the second end portion of the hang rod bracket may be inserted into a slot (broadly, an opening) in the pole cup to thereby removably attach (e.g., via a friction, interference or snap fit, etc.) the pole cup to the hang rod bracket. The hole in the hang rod bracket and the pole cup may be cooperatively configured such that the hole and any hanging marks are underneath and thus concealed by the pole cup.

Figure 1:
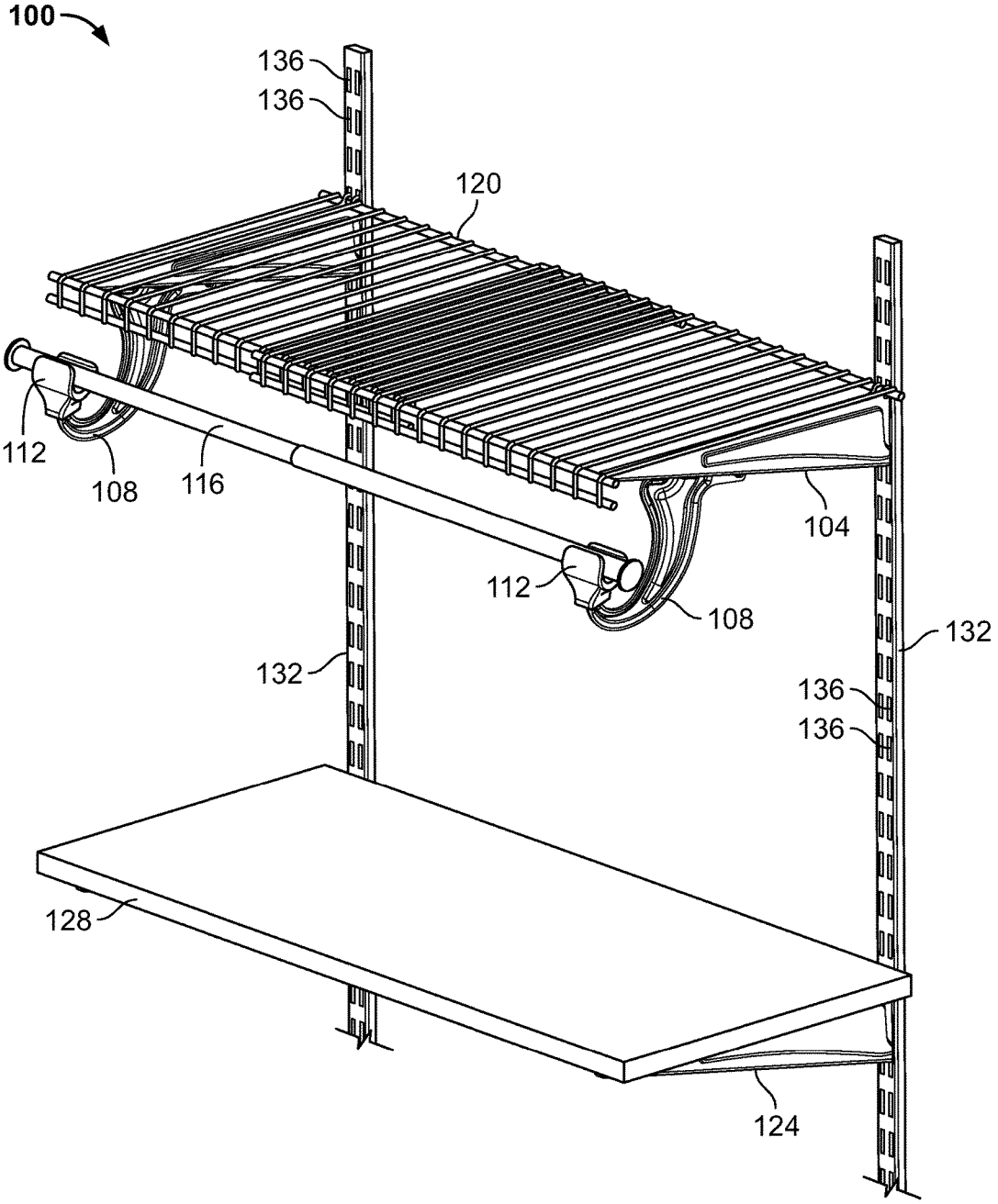
FIG. 1 is a perspective view of a storage system according to an exemplary embodiment.

With reference to FIG. 1, there is shown an exemplary embodiment of a storage system 100 embodying one or more aspects of the present disclosure. As shown, the storage system 100 generally includes an upper or first pair of shelf brackets 104, first and second (or left and right) hang rod brackets 108, first and second (or left and right) pole cups 112, a hang rod or pole 116, a ventilated or wire shelf 120, a second or lower pair of shelf brackets 124, a shelf 128 (e.g., laminate shelf, wooden shelf, plank shelf, etc.), and vertical uprights or standards 132.

As shown in FIG. 1, each standard or vertical upright 132 comprises a relatively narrow strip of material with two columns of slots 136 defined along the front surface of the standard 132. The standards 132 may be mounted vertically against a wall (e.g., a back wall of a closet, etc.). For example, the standards 132 may be fixedly mounted to a wall using screws, such that the standard is not generally adjustable, movable, or removable from its installed position. Or, for example, the standards 132 may be suspended from and slidably along a horizontal track or rail, which, in turn, is mounted to the wall.

The shelf brackets 104 may be supported from the corresponding standards 132 by inserting the tabs 140, 144 (FIGS. 14-16) of the shelf brackets 104 into corresponding slots 136 of the standards 132 (FIG. 1). The shelf brackets 104 may be constructed of any suitable material. By way of example only, the shelf brackets 104 may be formed from sheet metal. In addition, the shelf brackets 104 may also be provided in various lengths depending, for example, on the width of the particular shelf 120 to be supported by the brackets. For example, the shelf brackets 104 may each have an overall length of about sixteen inches (e.g., 16.34 inches, etc.) in some embodiments. Also by way of example, the shelf brackets 104 may each have an overall length of about twelve inches (e.g., 12.44 inches, etc.) in some embodiments.

As shown in FIGS. 14-16, each shelf bracket 104 includes a main body portion 148 and the tabs 140, 144. Each shelf bracket 104 may be mounted to the standard 132 by inserting the tabs 140, 144 located on the rearward end portion of the shelf bracket 104 into corresponding slots 136 of the standard 132. The upper tabs 140 begin at about the point where the back portion of the shelf bracket 104 extends outwardly and then in a downward direction, to thereby form or define a notch 152 (FIG. 16) between the main body portion 148 and the tab 140. Each notch 152 may be configured relative to (e.g., about equal to, greater than, less than) a thickness of the front surface portion of the standard 132. This may allow the shelf bracket 104 to be hooked onto the standard 132 by inserting the tabs 140 into slots 136 and then moving the shelf bracket 104 downward relative to the standard 132 so as to receive a mounting portion of the standard 132 within the notch 152. The notch 152 may have a full radius to prevent (or inhibit) tearing of material when placed in a loaded condition, and to assist in installation of the bracket tab 140 to the standard 132. A mounting portion of the standard 132 is generally referred to as that portion of the standard 132 that is received within and fits into the notch 152.

The shelf bracket 104 further includes lower or middle tabs 144 located at about the center of the back portion of the shelf bracket 104. The tabs 144 extend generally downwardly and form or define notches 156. Tabs 144, in conjunction with notches 156, may generally inhibit the front end of the shelf bracket 104 from being pushed up and becoming dislodged from the standard 132, and may also provide increased load-bearing capacity to shelf bracket 104. The upper portions of the tabs 144 protrude slightly and may operate or act as a stop when the shelf bracket 104 is installed to the standard 132. During use, the tab upper portions may help inhibit the shelf bracket 104 from being dislodged from the standard 132, for example, when the shelf bracket 104 is pushed in an upward direction. By way of example, FIG. 1 illustrates two shelf brackets 104 supported by the standard 132 where the two shelf brackets 104 are supporting the wire shelf 120.

With continued reference to FIGS. 14 through 16, the shelf brackets 104 also include tabs 160 extending outwardly relative to or along the top surface. The tabs 160 work in conjunction with notches 166 to hold a rear longitudinal rod of the wire shelf 120 (FIG. 1) in place such that rear longitudinal rod will not shift when a load is placed on the shelf 120. The tabs 160 may be bent downwardly over longitudinal rod and notches 166 after the shelf 120 is installed to thereby lock the rear longitudinal rod of the shelf 120 into place.

In another exemplary embodiment, the shelf brackets may further include tabs or projections (not shown) along the bottom of the shelf brackets. These tabs may be configured (e.g., sized, shaped, located, etc.) to also be received in slots 136 of the standard 132 when the shelf brackets are installed to the standard 132. Accordingly, this exemplary embodiment may include installing the shelf brackets to the standard by inserting all three sets of tabs in respective upper, middle, and lower pairs of slots 136 of the standard 132.

As shown in FIGS. 3, 14, 17, and 18, the shelf brackets 104 include first and second recesses or openings 170, 174 along the bottom portions of the shelf brackets 104. The openings 170, 174 are configured (e.g., sized, shaped, located, etc.) so as to engagingly receive first and second tabs 178, 182 of the hang rod brackets 108 as shown in FIG. 3, to thereby suspend or support the hang rod bracket 108 therefrom. The particular configuration (e.g., shape, spacing, location, etc.) of the openings 170, 174 may depend, for example, on the particular configuration of the tabs 178, 182 of the hang rod support brackets 108 to be supported or suspended from the shelf brackets 104.

As shown in FIGS. 3 and 14, each shelf bracket 104 also includes a resilient flexible tabs, tangs, or flap 184 (broadly, portions) that will flex or pivot inwardly out of the way when impinged by the third or rearward tab 186 along the first or upper end portion of the hang rod bracket 108. For example, the resilient flexible tab, tang, or flap 184 may flex or move inwardly into an opening that was formed in the bottom portion of the shelf bracket 104 when the resilient flexible tabs, tangs, or flap 184 was stamped from and bent outwardly relative to the bottom portion of the shelf bracket 104.

After the first and second tabs 178, 182 of the hang rod bracket 108 have been inserted into the respective first and second openings 170, 174 along the lower portion of the shelf bracket 104, the hang rod bracket 108 may then be slidably moved rearward relative to the shelf bracket 104. During this relative sliding movement, the third tab 186 of the hang rod bracket 108 may contact and cause the shelf brackets' resilient flexible tab 184 to flex or move inwardly away from the hang rod bracket's tab 186 thereby allowing the tab 186 to move across and beyond the shelf bracket's resilient flexible tab 184. The resiliently flexible tab 184 of the shelf bracket 104 may then resiliently flex, snap, or move back into its original, unflexed position. As shown in FIGS. 5 and 6, the resiliently flexible tabs 184 of the shelf brackets 104 may lockingly engage or contact upwardly protruding hook or latching portions of the third tabs 186 of the hang rod brackets 108 to thereby inhibit forward sliding movement of the hang rod brackets 108 relative to the shelf brackets 104. This, in turn, help inhibit accidental disengagement of the hang rod brackets 108 from the shelf brackets 104.

As shown in FIGS. 7, 8, and 9, the hang rod bracket 108 includes a slot, notch or opening 188 defined generally underneath the second tab 182. The notch 188 may be configured relative to (e.g., about equal to, greater than, less than) a thickness of the lower portion of the shelf bracket 104. This may allow the hang rod bracket 108 to be hooked onto the shelf bracket 104 by inserting the hang rod bracket's second tab 182 into the shelf bracket's opening 174 and then slidably moving the hang rod bracket 108 rearward relative to the shelf bracket 104 such that a portion of the shelf bracket 104 is received within the notch 188. In the fully installed position, the hang rod bracket's second and third tabs 182 and 186 may be disposed along opposite interior and exterior surfaces of the shelf bracket 104.

With continued reference in FIGS. 7, 8, and 9, the hang rod bracket's tabs 178 and 182 extend in opposite forward and rearward directions relative to a main body 190 of the hang rod bracket 108. The hang rod bracket 108 may also include a hole or opening 192, which may be used for hanging the hang rod bracket 108 when being coated. The hole 192 is located along the second end portion of the hang rod bracket 108 such that the hole 192 will be fully concealed when the pole cup 112 is removably attached to the second end portion of the hang rod bracket 108. As shown in FIG. 12, the hang rod bracket 108 may also include embossing 194 (e.g., embossed or stamped portions, etc.) protruding outwardly in opposite directions relative to a neutral center plane of the hang rod bracket 104. The embossing 194 may provide enhanced lateral stability for the single tab/slot configuration of the hang rod bracket 108.

As shown in FIG. 3, the second end portion of the hang rod bracket 108 may be inserted into a slot 196 (broadly, an opening) in the pole cup 112 to thereby removably attach (e.g., via a friction, interference or snap fit, etc.) the pole cup 112 to the hang rod bracket 108. Alternative embodiments may include a pole cup that is removably attached differently, fixedly attached to (e.g., welded, adhesively bonded, etc.), or integrally formed with a hang rod bracket.

As shown in FIGS. 21, 22, and 23, the pole cup 112 includes an opening 197 in which a portion of the hang rod or pole 116 may rest when supported thereby. The opening 197 has a generally C-shaped profile. The pole cup 112 may also include generally opposing ribs or protruding portions 198 along the top of the opening 197. The ribs 198 may help retain the portion of the hang rod or pole 116 within the opening 197, and thereby help inhibit accidental removal of the hang rod or pole 116 out of the pole cup 112.

The hang rod or pole 116 may comprise a single-piece pole, a multi-piece pole, and/or telescopically adjustable hang rod or pole, etc. The hang rod 116 may be hollow or solid. In the exemplary embodiment shown in FIG. 2, the hang rod 116 is hollow, and end caps 199 may be inserted into the open end portions of the hollow hang rod 116. By way of example, the end caps 199 may be configured as self-adjusting press fit end caps, which may be used to help inhibit hangers from sliding off the end of the hang rod 116. As shown in FIG. 2, the end caps 199 include forks or end portions having protrusions thereon in a sawtooth or jagged configuration. When the end caps 199 are inserted, the forks may be compressed generally towards each other for fitting into the open end portions of the hollow hang rod 116. The forks may have sufficient restorative force for urging the forks outwardly to spread apart thereby creating a relatively good friction or interference fit between the forks and interior sidewalls of the hollow hang rod 116. Alternative embodiments may include differently configured end caps or no end caps.

As shown in FIG. 1, the hang rod 116 may be supported from below by the first and second end cups 112 such that the first and second end cups 112 do not interfere with sliding movement of clothes hangers along the hang rod 116. Clothes hangers may be freely slidable along the hang rod 116 without interference from the first and second end cups 112, hang rod 116, or hang rod brackets 108.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

a hang rod bracket including first, second, and third tabs along an upper portion of the hang rod bracket; and a shelf bracket including first and second openings and a resiliently flexible tang along a lower portion of the shelf bracket, the first and second openings configured for receiving the first and second tabs, respectively, of the hang rod bracket, to thereby support the hang rod bracket from the shelf bracket, the resiliently flexible tang configured to be resiliently movable in a first direction when impinged by the third tab of the hang rod bracket and resiliently movable in a second, opposite direction when the third tab has been rearwardly moved relative to the resiliently flexible tang such that the third tab is behind and no longer impinging the resiliently flexible tang, whereby the resiliently flexible tang is engageable with the third tab to inhibit forward movement of the hang rod bracket along the shelf bracket.

2. The assembly of claim 1, wherein the first and second tabs of the hang rod bracket extend in opposite forward and rearward directions.

3. The assembly of claim 2, wherein:

the hang rod bracket includes a notch defined generally underneath the second tab; and the notch is configured to receive a portion of the shelf bracket therein such that the second and third tabs of the hang rod bracket are along opposite interior and exterior surfaces, respectively, of the lower portion of the shelf bracket.

4. The assembly of claim 3, wherein the hang rod bracket and the shelf bracket are configured such that the first and second tabs of the hang rod bracket are insertable into the first and second openings of the shelf bracket and thereafter the hang rod bracket is rearwardly slidable relative to the shelf bracket to thereby position the portion of the shelf bracket within the notch and generally between the second and third tabs of the hang rod bracket, whereby during the rearward sliding movement of the hang rod bracket relative to the shelf bracket, the third tab contacts and causes the resiliently flexible tang to flex inwardly from an original position thereby allowing the third tab to move across and beyond the resiliently flexible tang whereupon the resiliently flexible tang flexes outwardly back towards the original position and lockingly engages an upwardly protruding hook of the third tab to inhibit forward sliding of the hang rod bracket along the shelf bracket thereby helping to prevent accidental disengagement of the hang rod bracket from the shelf bracket.

5. The assembly of claim 1, wherein:

the third tab includes an upwardly protruding hook; and the resiliently flexible tang is configured to resiliently flex inwardly from an original position when impinged by the third tab and to resiliently flex outwardly back towards the original position after the third tab has been slidably moved across and beyond the resiliently flexible tang, whereupon the resiliently flexible tang lockingly engages the upwardly protruding hook of the third tab to inhibit forward sliding of the hang rod bracket along the shelf bracket thereby helping to prevent accidental disengagement of the hang rod bracket from the shelf bracket.

6. The assembly of claim 1, wherein the shelf bracket includes an opening along the lower portion of the shelf bracket that is generally above the resiliently flexible tang into which the resiliently flexible tang is inwardly movable when impinged by the third tab of the hang rod bracket.

7. The assembly of claim 6, wherein:

the opening generally above the resiliently flexible tang is located where material was stamped and removed to thereby form the resiliently flexible tang, whereby an absence of the stamped and removed material defines the opening generally above the resiliently flexible tang; and the hang rod bracket includes a main body having embossing in opposite directions relative to a neutral center plane of the hang rod bracket.

8. The assembly of claim 1, wherein:

the shelf bracket includes an upper portion configured for supporting a portion of a shelf thereon; and the hang rod bracket includes a pole cup attached to or integrally formed with a lower portion of the hang rod bracket, the pole cup configured for receiving a portion of a hang rod therein.

9. A storage system comprising the assembly of claim 1.

10. A storage system comprising first and second hang rod brackets and first and second shelf bracket according to the assembly of claim 1, wherein the first and second hang rod brackets are configured to be supported by the respective first and second shelf brackets, wherein the storage system further comprises:

a hang rod including first and second portions;

first and second pole cups attached to or integrally formed with lower portions of the respective first and second hang rod brackets, the first pole cup configured for receiving the first portion of the hang rod, the second pole cup configured for receiving the second portion of the hang rod; and a shelf configured to be supported along upper portions of the first and second shelf brackets;

whereby the hang rod is supportable below the shelf by the respective first and second pole cups when the first and second hang rod brackets are supported by the respective first and second shelf brackets and when the shelf is supported along the upper portions of the first and second shelf brackets.

11. A storage system comprising:

a shelf bracket including an upper portion configured for supporting a portion of a shelf thereon and first and second openings and a resiliently flexible tang along a lower portion of the shelf bracket;

a hang rod bracket including first, second, and third tabs along an upper portion of the hang rod bracket, the hang rod bracket configured to be supported by the shelf bracket when the first and second tabs are received within the first and second openings, respectively;

wherein the resiliently flexible tang is configured to be resiliently movable in a first direction when impinged by the third tab of the hang rod bracket and resiliently movable in a second, opposite direction when the third tab has been rearwardly moved relative to the resiliently flexible tang such that the third tab is behind and no longer impinging the resiliently flexible tang, whereby the resiliently flexible tang is engageable with the third tab to inhibit forward movement of the hang rod bracket along the shelf bracket.

12. The storage system of claim 11, wherein:

the shelf bracket comprises first and second shelf brackets;

the hang rod bracket comprises first and second hang rod brackets configured to be supported by the respective first and second shelf brackets;

wherein the storage system further comprises:

a hang rod including first and second portions;

first and second pole cups attached to or integrally formed with lower portions of the respective first and second hang rod brackets, the first pole cup configured for receiving the first portion of the hang rod, the second pole cup configured for receiving the second portion of the hang rod; and a shelf configured to be supported along upper portions of the first and second shelf brackets;

whereby the hang rod is supportable below the shelf by the respective first and second pole cups when the first and second hang rod brackets are supported by the respective first and second shelf brackets and when the shelf is supported along the upper portions of the first and second shelf brackets.

13. The storage system of claim 11, further comprising:

a hang rod; and a pole cup attached to or integrally formed with the lower portion of the hang rod bracket, the pole cup configured for receiving a portion of the hang rod therein.

14. The storage system of claim 11, wherein the first and second tabs of the hang rod bracket extend in opposite forward and rearward directions.

15. The storage system of claim 14, wherein:

the hang rod bracket includes a notch defined generally underneath the second tab; and the notch is configured to receive a portion of the shelf bracket therein such that the second and third tabs of the hang rod bracket are along opposite interior and exterior surfaces, respectively, of the lower portion of the shelf bracket.

16. The storage system of claim 15, wherein the hang rod bracket and the shelf bracket are configured such that the first and second tabs of the hang rod bracket are insertable into the first and second openings of the shelf bracket and thereafter the hang rod bracket is rearwardly slidable relative to the shelf bracket to thereby position the portion of the shelf bracket within the notch and generally between the second and third tabs of the hang rod bracket, whereby during the rearward sliding movement of the hang rod bracket relative to the shelf bracket, the third tab contacts and causes the resiliently flexible tang to flex inwardly from an original position thereby allowing the third tab to move across and beyond the resiliently flexible tang whereupon the resiliently flexible tang flexes outwardly back towards the original position and lockingly engages an upwardly protruding hook of the third tab to inhibit forward sliding of the hang rod bracket along the shelf bracket thereby helping to prevent accidental disengagement of the hang rod bracket from the shelf bracket.

17. The storage system of claim 11, wherein:

the third tab includes an upwardly protruding hook; and the resiliently flexible tang is configured to resiliently flex inwardly from an original position when impinged by the third tab and to resiliently flex outwardly back towards the original position after the third tab has been slidably moved across and beyond the resiliently flexible tang, whereupon the resiliently flexible tang lockingly engages the upwardly protruding hook of the third tab to inhibit forward sliding of the hang rod bracket along the shelf bracket thereby helping to prevent accidental disengagement of the hang rod bracket from the shelf bracket.

18. The storage system of claim 11, wherein the shelf bracket includes an opening along the lower portion of the shelf bracket that is generally above the resiliently flexible tang into which the resiliently flexible tang is inwardly movable when impinged by the third tab of the hang rod bracket.

19. The storage system of claim 18, wherein:

the opening generally above the resiliently flexible tang is located where material was stamped and removed to thereby form the resiliently flexible tang, whereby an absence of the stamped and removed material defines the opening generally above the resiliently flexible tang; and the hang rod bracket includes a main body having embossing in opposite directions relative to a neutral center plane of the hang rod bracket.

20. A storage system comprising:

first and second hang rod brackets each including first, second, and third tabs along an upper portion of the corresponding first and second hang rod brackets, the first and second tabs of the hang rod bracket extending in opposite forward and rearward directions, the third tab including an upwardly protruding hook; and first and second shelf brackets each including first and second openings and a resiliently flexible tang along a lower portion of the corresponding first and second shelf bracket, wherein:

the first and second openings are configured for receiving the first and second tabs, respectively, of the corresponding first and second hang rod brackets to thereby support the first and second hang rod brackets from the corresponding first and second shelf brackets; and the resiliently flexible tangs are configured to be resiliently movable in a first direction when impinged by the third tabs of the corresponding first and second hang rod brackets and resiliently movable in a second, opposite direction when the third tabs have been rearwardly moved relative to the resiliently flexible tangs such that the third tabs are behind and no longer impinging the resiliently flexible tangs, whereby the resiliently flexible tangs are engageable with the upwardly protruding hooks of the third tabs to inhibit forward movement of the first and second hang rod brackets along the corresponding first and second shelf brackets.

21. The storage system of claim 20, further comprising:

a hang rod including first and second portions;

first and second pole cups attached to or integrally formed with lower portions of the respective first and second hang rod brackets, the first pole cup configured for receiving the first portion of the hang rod, the second pole cup configured for receiving the second portion of the hang rod; and a shelf configured to be supported along upper portions of the first and second shelf brackets;

whereby the hang rod is supportable below the shelf by the respective first and second pole cups when the first and second hang rod brackets are supported by the respective first and second shelf brackets and when the shelf is supported along the upper portions of the first and second shelf brackets.

* * * * *